United States Patent [19]

Grellet

[11] 3,957,594

[45] May 18, 1976

[54] SURFACE TREATMENT OF PARTS OF FERROUS ALLOYS

[76] Inventor: Bernard Grellet, 67 Cours Fauriel, 42000 Saint-Etienne, France

[22] Filed: Sept. 9, 1974

[21] Appl. No.: 504,091

[30] Foreign Application Priority Data

Sept. 14, 1973 France ..... 73.33032

[52] U.S. Cl. ..... 204/37 T; 204/43 S; 204/44

[51] Int. Cl.[2] ..... C25D 5/50; C25D 3/58

[58] Field of Search ..... 204/37 T, 44, 43 S

[56] References Cited

UNITED STATES PATENTS

| | | | |
|---|---|---|---|
| 2,397,522 | 4/1946 | Baier | 204/44 |
| 2,793,990 | 5/1957 | Heymann et al | 204/44 |

FOREIGN PATENTS OR APPLICATIONS

| | | | |
|---|---|---|---|
| 589,461 | 6/1947 | United Kingdom | 204/44 |
| 732,538 | 6/1955 | United Kingdom | 204/44 |
| 741,864 | 12/1955 | United Kingdom | 204/44 |

OTHER PUBLICATIONS

Brenner, "Electrodeposition of Alloys," Academic Press, N.Y. Vol. I., 1963, Chapter 15, pp. 500–507.

*Primary Examiner*—Howard S. Williams
*Assistant Examiner*—Aaron Weisstuch
*Attorney, Agent, or Firm*—Young & Thompson

[57] ABSTRACT

The surface of a ferrous alloy is treated by electrolytic deposition of a copper-tin alloy surface layer followed by the diffusion heat treatment of the coated surface. Electrolysis is carried out in a bath containing monovalent copper ions, tetravalent tin ions, an alkali metal hydroxide, an alkali metal cyanide, alkali metal carbonates, alkali metal stannites, and an alkali metal citrate; and the diffusion heat treatment is carried out at between 500° and 580°C.

1 Claim, No Drawings

SURFACE TREATMENT OF PARTS OF FERROUS ALLOYS

BACKGROUND OF THE INVENTION

1. Field of the Invention

The present invention relates to a process for the treatment of surfaces of ferrous alloys to improve their frictional properties and resistance to wear and seizure, and to impart to them good accommodation capacity and good fatigue, by forming on the surfaces, by diffusion, intermetallic or semi-metallic compounds.

Note: by "accommodation capacity" should be understood the property possessed by surfaces to better distribute the loads pressing on them when originally they were not parallel and in conformity with the loading member surface.

2. Description of the Prior Art

At the present time various processes are known which make it possible to obtain coatings of this kind on the surface of a metal. This is in particular true of French Patent No. 1530 of the 6th May 1967 and its five certificates of addition, which describe processes for forming composite anti-friction layers by depositing a metal coating on a metal surface and then subjecting it to a suitable heat treatment. Two techniques have been proposed:

1st technique

First, the deposition of successive layers of metals on the metal parts to be treated;

then diffusion in a preferably neutral or reducing atmosphere, in accordance with a thermal cycle comprising two separate phases: first heating to a temperature at least 20°C below the melting point of the most readily fusible of the metals present, then heating to a temperature between the said melting point and 800°C.

2nd technique

Firstly, deposition on the part of a layer of an alloy of two or more metals, then the baking of the part coated in this manner, optionally in a single stage.

In comparison with the first technique this second technique permits a shortening of the time during which the selected diffusion temperature is maintained.

After diffusion, the treated part presents in both cases, from inside to outside:

the base metal;

a layer of residual metal;

a layer formed of metallic compounds of a thickness greater than 10 microns and of a hardness above 500 Vickers at 0.15 N;

a residual surface layer of a thickness less than 4 microns of one of the metals present.

The preceding technique is applicable to ferrous alloys and an example is described in the previously mentioned French Specification, in which the diffusion coating is produced from copper and tin, the temperature of the last stage of the heat treatment being indicated as equal to 600°C. In this case the part presents after treatment, from inside to outside:

the base ferrous alloy, a residual layer of copper, a layer of copper-tin alloy formed of various phases and of a Vickers hardness between 500 and 800 at 0.15 Newton, a surface layer of tin of a thickness of 1 micron.

These techniques for producing diffusion coatings based on copper and tin, when applied to ferrous alloys, nevertheless have disadvantages of which the principal are the following:

a. the layers formed have great porosity. When subjected to friction, this coating morphology results in rapid wear of the porous zone and a substantial progressive increase of the coefficient of friction; at a certain degree of wear there may even be epidermic sticking and seizure.

b. the presence of a layer of copper having poor mechanical characteristics under a layer of fragile compounds having good mechanical characteristics results in pronounced overall fragility of the composite layer, which prevents it from following any substantial deformations of the substrate without fracturing.

c. the fact that the hardness of the intermediate layer composed of metal compounds is higher than 500 Vickers entails very great fragility of this layer, which when subjected to friction may lead to flaking off.

In the above mentioned process, in the case of the copper and tin alloy originally deposited on the metal part, this alloy was obtained from known baths, for example baths based on cyanides, pyrophosphates, and fluoborates.

Nevertheless, these baths have the following main disadvantages:

a. the composition of the alloy deposited varies from one point to another on the treated part, and this variation is considerable. When the tin content of the mixed coating is lower than 17% by weight, the alloy, when subjected to friction becomes covered with copper, which in practice is incompatible with the usual mechanical parts, particularly steels, which have to rub against parts of treated ferrous alloys.

When the tin content exceeds 23% by weight, the fragility of the alloys formed becomes excessive and thus eliminates any possibility of accommodation of the composite layer formed. Furthermore, the parts coated with these alloys having a high tin content have their fatigue life reduced in proportions which may be as high as 25 or 30%.

b. These baths are chemically unstable, that is to say they rapidly change in the course of time and it is not possible for an alloy of a constant given composition to be deposited on successive parts, which, for a diffusion temperature suitable for a given composition of copper-tin alloy, results in partial fusion of the alloy in certain zones of the part, thereby irreversibly changing the surface states.

An object of the present invention is to provide a process by which it is possible, under industrial large-scale production conditions, to obtain on surfaces of ferrous alloys a coating having good frictional properties without seizing and with reduced wear, which is capable of following without fracturing any deformation, even substantial deformation, of its substrate, and which is not subject to surface creep.

SUMMARY

The invention provides a process for the treatment of surfaces of ferrous alloys by depositing a copper-tin alloy, followed by diffusion heat treatment, characterised in that the deposition is effected electrolytically in a bath containing monovalent copper ions, tetravalent tin ions, an alkali metal hydroxide, an alkali metal cyanide, alkali metal carbonates, alkali metal stannites, and an alkali metal citrate, these products being used in accurately defined proportions which, according to the original feature of the invention, must be concurrently respected, and in that the diffusion heat treatment is effected at a temperature between 500° and 580°C.

In order to obtain a friction coating having the properties indicated above, after being subjected to degreasing and pickling treatments known per se the part is electrolytically coated with a copper-tin alloy in a bath according to the invention, the operating conditions of which are controlled within the undermentioned limits:

mass ratio of tin metal to copper metal between 1.5 and 4;

content of alkali metal citrate between 0.1 and 0.3 gram per gram of copper metal in the bath;

pH between 13.5 and 14 and kept beween these values by adjusting the alkali metal metal hydroxide content of the bath;

concentration of free alkali metal hydroxide between 12 and 20 grams per liter;

concentration of alkali metal carbonates between 30 and 200 grams per liter;

ratio of alkali metal hydroxide to alkali metal cyanide between 1 and 1.5;

alkali metal stannite content between 15 and 30 mg/l, bath temperature between 50° and 60°C;

cathodic current density between 3 and 10 A/dm$^2$;

anodic current density between 1.5 and 7 A/dm$^2$.

After deposition of the desired thickness, the part is rinsed and dried and subjected to the diffusion heat treatment at a temperature between 500° and 580°C in a neutral or reducing atmosphere for a period between 1 and 3 hours.

By this process it is possible to form a non-porous friction coating of constant composition throughout its thickness and at any point of the treated part.

Furthermore, the friction coating produced according to the invention is not very fragile and has good fatigue life characteristics; moreover, this coating has the unexpected property of providing a friction surface with a low coefficient of friction without any unalloyed tin appearing on the surface, as occurs in the case of the above mentioned prior art processes.

Micrographic examination of a section made in a part of this kind shows the presence on the surface of a layer which is perfectly regular whatever part of the surface is examined, which has perfect adhesion, and a hardness between 250 and 400 Vickers at 0.15 Newton. This coating contains copper and tin in the proportion of 20±2% by weight of tin in copper; it is composed of hard but non-fragile Cu/Sn compounds.

DESCRIPTION OF THE PREFERRED EMBODIMENT

The following Example relates to a geared motor of the tangent screw and wheel type, in which the screw is of high frequency hardened steel XC48; the input speed is 1500 rpm and the output speed 28 rpm.

The geared motor operated continuously in the presence of Vaseline oil and it was observed that:

with a wheel of bronze of the UE 12 P type and with a torque of 25 m.N, the wheel was destroyed after operating for 144 hours;

with a wheel of annealed steel XC 48 treated in accordance with the invention, that is to say first covered with a layer of 20 microns of copper-tin alloy containing 20% of tin and then subjected to heat treatment for 2 hours at 550°C in an atmosphere of nitrogen, it is possible to transmit a torque of 40 m.N, and the test was voluntarily stopped at the end of 2000 hours of operation.

In this example, the wheel of annealed steel XC 48 was subjected to the treatment of the invention in the following manner:

a. the part was first degreased and pickled;

b. the part was then rinsed and thereupon immersed in an electroplating bath to receive a concurrent deposition of copper and tin of a thickness of 20 microns; the bath had the composition previously indicated in the description of the invention and the following conditions were adopted:

ratio by weight of tin metal to copper metal in the bath equal to 3;

content of free alkali metal hydroxide equal to 18 g per liter of bath;

alkali metal citrate content equal to 0.25g of the said citrate per gram of copper in the bath;

content of alkali metal carbonates equal to 80 g per liter of bath;

content of sodium stannite equal to 25 mg per liter of bath;

ratio of free alkali metal hydroxide to free alkali metal cyanide equal to 1.2;

pH equal to 13.8;

temperature of bath: 55°C, density of cathodic current 4 A/dm$^2$:

density of anodic current 2 A/dm$^2$:

c. finally, the wheel coated in this manner was washed, dried, and then kept for two hours in an atmosphere of nitrogen at a temperature of 550°C.

In a second non-limitative example, rotary bending fatigue tests were carried out with test pieces of annealed carbon steel of the XC 38 type; when the test pieces are not treated their limit of endurance is 40 hbar; however, when the test pieces are treated in accordance with the invention their endurance limit is 52 hbar, that is to say an increase of 30% compared with the untreated test pieces.

What I claim is:

1. A process for the treatment of the surface of a ferrous alloy, comprising the steps of a. depositing a copper-tin alloy on the said surface by electrolysis in a bath containing monovalent copper ions, tetravalent tin ions, an alkali metal hydroxide, an alkali metal cyanide, alkali metal carbonates, alkali metal stannites, and an alkali metal citrate, and b. subjecting the coated surface to a diffusion heat treatment at a temperature between 500° and 580°C., the mass ratio of tin metal to copper metal in the bath being between 1.5 and 4, the alkali metal citrate content of the bath being between 0.1 and 0.3 gram of the said citrate per gram of copper metal in the bath, the concentration of alkali metal stannite in the bath being between 15 and 30 mg per liter, the ratio of free alkali metal hydroxide to free alkali metal cyanide being between 1 and 1.5, the concentration of free alkali metal hydroxide of the bath being between 12 and 20 grams per liter, the concentration of alkali metal carbonates in the bath being between 30 and 200 grams of carbonates per liter, the pH of the bath being between 13.5 and 14, this pH being maintained between these two values by varying the alkali metal hydroxide content of the bath, the temperature of the bath being between 50° and 60°C., the cathodic current density being between 3 and 10A/dm$^2$, the anodic current density being between 1.5 and 7A/dm$^2$, the diffusion heat treatment being effected in a neutral or reducing atmosphere for a time between 1 and 3 hours.

* * * * *